US005556229A

United States Patent [19]

Bishop et al.

[11] Patent Number: 5,556,229

[45] Date of Patent: Sep. 17, 1996

[54] SHORELINE EROSION CONTROL SYSTEM

[76] Inventors: Robert J. Bishop; Justin D. Bishop, both of 1083 Bloomfield Ave., W. Caldwell, N.J. 07006

[21] Appl. No.: 368,649

[22] Filed: Jan. 4, 1995

[51] Int. Cl.[6] ..... E02B 3/04

[52] U.S. Cl. ..... 405/27; 405/25; 405/21; 405/32; 405/30

[58] Field of Search ..... 405/15, 21, 22, 405/23, 25, 26, 27, 28, 30, 32–35

[56] References Cited

U.S. PATENT DOCUMENTS

| | | | |
|---|---|---|---|
| 307,393 | 10/1884 | Hyde | 405/26 |
| 1,004,718 | 10/1911 | Wieland | 405/26 |
| 1,635,899 | 12/1926 | Nohlen | 405/28 |
| 3,373,568 | 3/1968 | Hornbostel, Jr. | 405/21 |
| 3,848,419 | 11/1974 | Bowley | 405/26 |
| 3,863,455 | 2/1975 | Fuller | 405/27 |
| 4,947,791 | 8/1990 | Laier et al. | 405/26 X |

FOREIGN PATENT DOCUMENTS

| | | | |
|---|---|---|---|
| 2531987 | 2/1984 | France | 405/25 |
| 0258011 | 11/1987 | Japan | 405/26 |
| 1163173 | 9/1969 | United Kingdom | 405/26 |

*Primary Examiner*—Michael Powell Buiz
*Assistant Examiner*—Frederick L. Laoman
*Attorney, Agent, or Firm*—Weingram & Zall

[57] ABSTRACT

A dynamic shoreline erosion control system includes a plurality of large rotatable hollow spheres spaced along a line at a distance from the shoreline. The spheres are held together by a heavy duty strong flexible netting which permits movement of the spheres with the incoming and outgoing waves. Openings in the spheres permit the sea water to pass through. A plurality of smaller air-filled balls are disposed within the spheres to likewise rotate under the influence of water flow and provide buoyancy. A group of spheres within a common netting is tied to a pair of pilings at the ends of the netting to limit the extent of movement. Narrower sections of the netting between spheres provide a link and spacing for adjacent elements. Like groups of spheres in nettings can be disposed in parallel pairs with staggered spacing and an array of spaced groups in various geometric arrangements can extend along a large shore area. The combined effects of the netting, spheres and balls serve to dissipate wave energy to reduce shore erosion and can trap sand that would normally be washed away to permit restoration of shore areas.

9 Claims, 4 Drawing Sheets

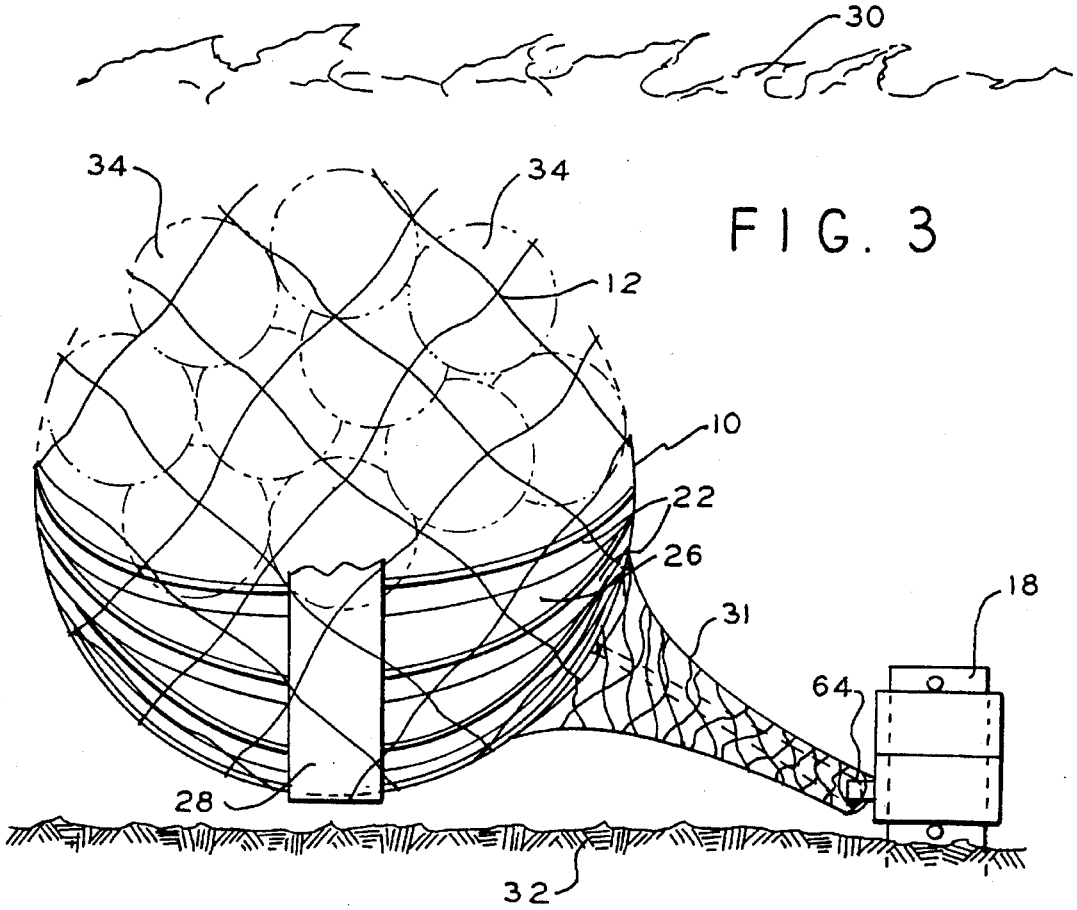
FIG. 3
FIG. 4
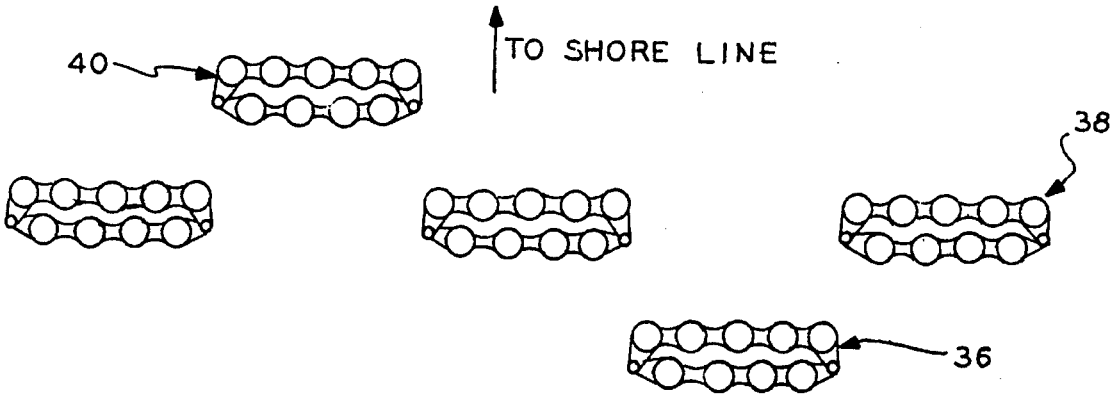

SHORELINE EROSION CONTROL SYSTEM

BACKGROUND OF THE INVENTION

1. Field of the Invention

The present invention relates to devices for reducing the erosion of shoreline caused by the force of waves and particularly to structures which more efficiently dissipate wave energy to minimize damage to beaches and harbors.

2. Description of the Prior Art

Presently known systems for reducing damage to the shoreline by waves include the use of breakwaters such as sea walls, jettys and sand groins, extending on the ocean floor or along the shore to act as barriers to obstruct or deflect the waves. Other systems utilize surface floatation devices spaced along the shoreline in the path of the waves to dissipate the energy. These devices have generally been extremely costly and inefficient.

SUMMARY OF THE INVENTION

It is therefore the primary object of the present invention to provide a unique system for reducing the effects of waves on the shoreline.

It is another object of the invention to minimize erosion of the shoreline by more efficiently dissipating wave energy.

A further object of the invention is to provide a dynamic structure having a plurality of rotatable elements spaced along the ocean floor and having means for limiting the movement thereof.

An additional object of the invention is to provide a plurality of rotatable elements linked together and secured to the ocean floor between two end points and being rotatable by movement of the ocean waves and tides.

It is also an object of the invention to provide a plurality of rotatable elements positioned along inner and outer lines in a staggered arrangement with elements of one line positioned between gaps in the other line.

These objects are achieved with a novel arrangement of a plurality of like large hollow rotatable spheres spaced along the ocean floor and linked together to form lines generally parallel to the shoreline. The spheres have openings permitting the sea water to flow into and out of the spheres under the influence of waves ebbing and flowing to and from the shoreline. A plurality of smaller air filled balls are disposed within each large sphere to rotate with the flow of water and aid the large spheres in the absorption and dissipation of wave energy. The spheres are positioned in the tidal area close to the shoreline so that they will be submerged both at low tide and high tide. The spheres are enclosed in heavy duty netting around each individual sphere with linking netting connecting a plurality of spheres in a line along the shore. A second line of spheres spaced from the first line is positioned behind gaps in the first line and enclosed and linked in a like netting. The groups of spheres in the first and second lines are secured together at the ends by the netting which also connects to pilings embedded in the ocean floor. The heavy netting provides further wave energy dissipation and permits limited movement of each sphere and of the entire system between the pilings. Several groups of like systems can be aligned along an extended shoreline area to cover any desired distance. Other objects and advantages will become apparent from the following description and accompanying drawings.

BRIEF DESCRIPTION OF THE DRAWINGS

FIG. 3 is a partial section showing a sphere containing a plurality of air filled balls held within netting secured to a piling.

FIG. 4 shows a schematic arrangement of several groups of like parallel line barriers spaced at varying distances along a shoreline to form an extended erosion prevention system.

DESCRIPTION OF THE PREFERRED EMBODIMENTS

Figure 1:
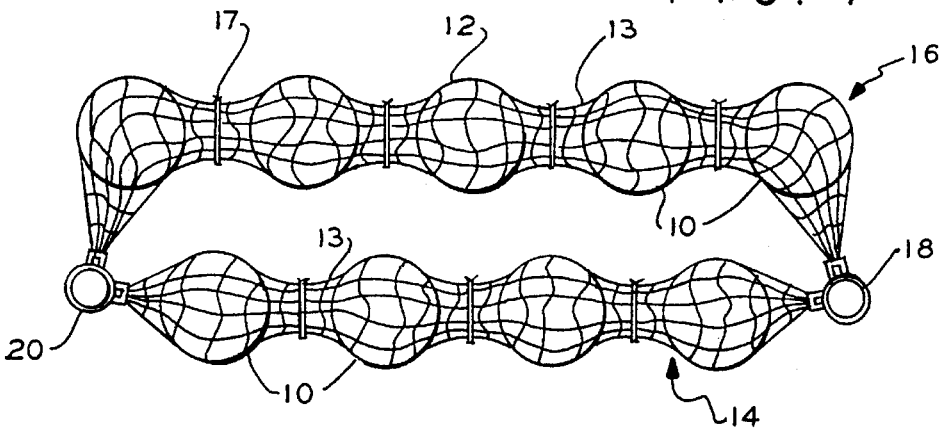
FIG. 1 is a plan view of a plurality of rotatable spheres spaced apart and linked together and enclosed within netting to form a movable wave energy dissipating barrier along an ocean floor. Two spaced parallel rows of spheres having staggered positions are secured by the netting at the ends to pilings embedded in the ocean floor.

As shown in FIG. 1, a plurality of rotatable spheres 10 are enmeshed in a heavy duty netting 12. The netting surrounds each individual sphere and a narrower linking area 13 spaces each sphere apart to typically enclose a group of four spheres in one row 14 and five in a second row 16. Individual spheres in each parallel row are positioned alternately so that one is not directly behind another. The spheres may be about six feet in diameter with a spacing of about three feet between each in the same row. The spacing is maintained by ties or clamps 17 around the netting between spheres. The netting at the ends of the two rows are tied to pilings 18, 20, or other anchoring means, embedded in the sea or ocean floor. The netting is preferably of a thick high strength flexible nylon. The pilings are preferably of wood or a sturdy metal. The length of the two rows may be about forty eight feet with the center lines of the two rows about seven feet apart. The ends of the netting connected to the pilings may be about three feet long.

Figure 2A:
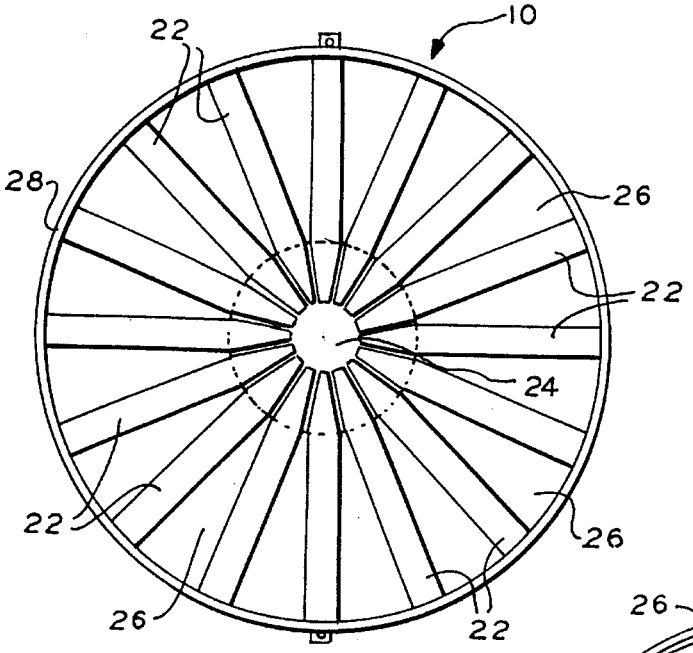
FIGS. 2*a* and 2*b* are top and side views of one rotatable sphere in the form of a cage of metal bands having open spaces for the passage of sea water therethrough.
Figure 2B:
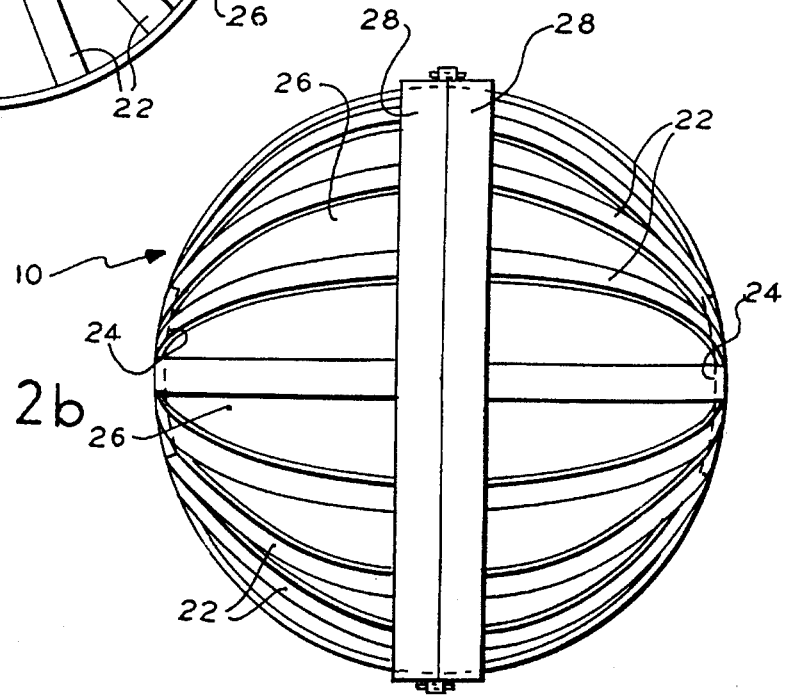

As shown in FIGS. 2*a* and 2*b*, a typical sphere 10 is formed of a plurality of arcuate metal bands or strips 22 welded together to a disc 24 at the poles to form a cage structure having openings 26 permitting the flow of sea water therethrough. The cage may be formed of two halves that are assembled and bolted together. The strips can typically be about four inches wide and one quarter inch thick with a total of sixteen to complete the sphere. The two center bands 28 joining the two halves can be six inches wide and one quarter inch thick. The disc 24 can be two feet in diameter at each pole. The cage can also be of an oval or elliptical shape instead of spherical. It may also be constructed of other suitable materials such as thick high strength plastic.

As shown in FIG. 3, a sphere 10 is positioned below the surface of the water 30 and connected by the end 31 of netting 12 to a piling 18 in the sea floor 32. A plurality of hollow air filled balls 34 are enclosed within the cage structure of the sphere. The balls are preferably of plastic and include a valve for controlling the air pressure therein. The balls may be about eighteen inches in diameter and number about ten within each sphere. The number of balls and air pressure permit the sphere to float about two inches above the sea floor. This can be varied by changing the number and pressure of the balls. The metal cage can weigh about six hundred pounds so that floatation above the sea floor avoids wear of the surrounding netting.

As shown schematically in FIG. 4, a plurality of groups of spheres enclosed in netting, such as the two row arrangement of FIG. 1, are disposed along an extended shoreline area in a tidal area which may be about two hundred yards from the shoreline. Each group of nine spheres can be arranged in staggered rows to overlap a specified length along the shore. For example, the three parallel rows 36, 38, 40 can be spaced at twenty five foot intervals of distance from the shoreline, while each group is staggered with respect to the row in front and behind so as provide a uniformly distributed barrier to the wave formation perpendicular to the shoreline. Each group can be about forty eight feet long with a spacing of about forty two feet between groups in the same row. The depth of the spheres will change with the tide and distance from the shore. This can vary from eight feet underwater, for example, at low tide, to about eleven feet at high tide. The groups of spheres can form other arrangements such as serpentine lines or various geometric shapes.

Figure 5:
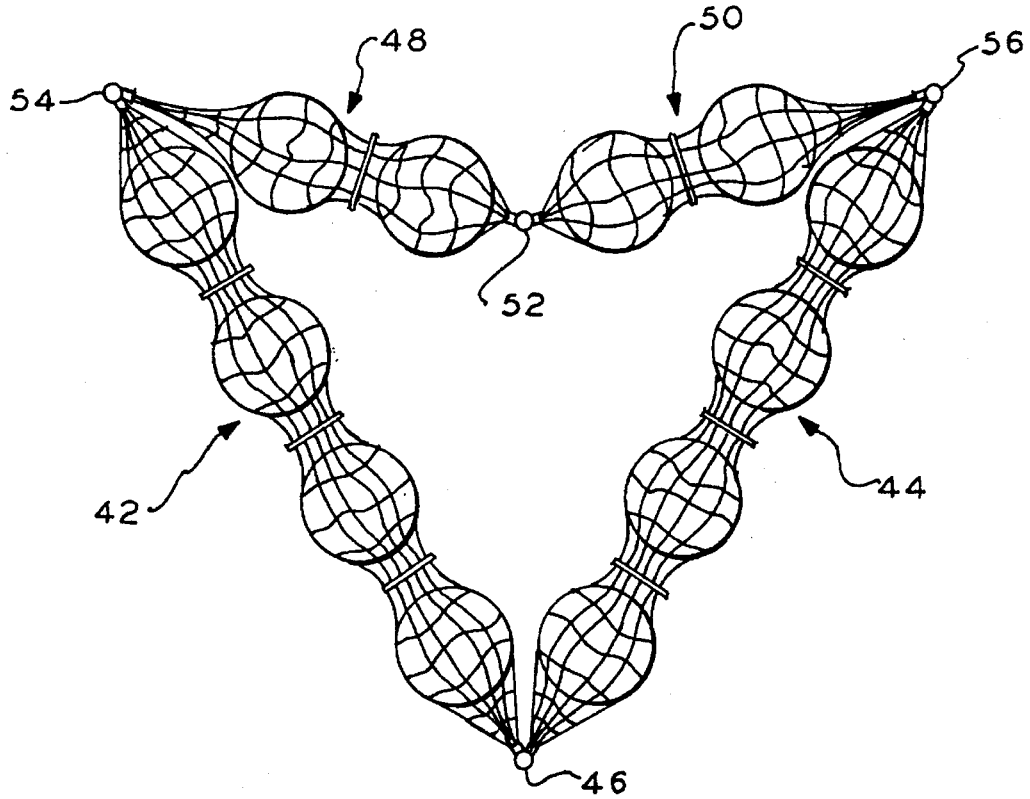
FIG. 5 is another arrangement of a plurality of spheres enclosed in netting to form a triangular or wedge shaped barrier.

FIG. 5 shows an arrangement of groups of spheres enclosed in netting to form a triangular or wedge-shaped barrier. In this case, two groups of four spheres 42,44 are connected by the ends of the netting to a piling 46 at a common apex. Groups 42 and 44 form two legs of the triangle. The third leg includes two further groups 48, 50 of two spheres connected together at a common piling 52. The opposite ends of groups 48, 50 are connected to the other ends of groups 42, 44 at pilings 54, 56. In this case the spacing of spheres in groups 42, 44 may be about nine feet between centers and seven feet at the end sphere center to the pilings. Groups 48, 50 may be spaced at eight feet between the centers of the two spheres and ten feet from the outer spheres centers to pilings 54, 56 and five feet from the inner spheres centers to piling 52. The pilings may typically be about one foot in diameter.

Figure 6:
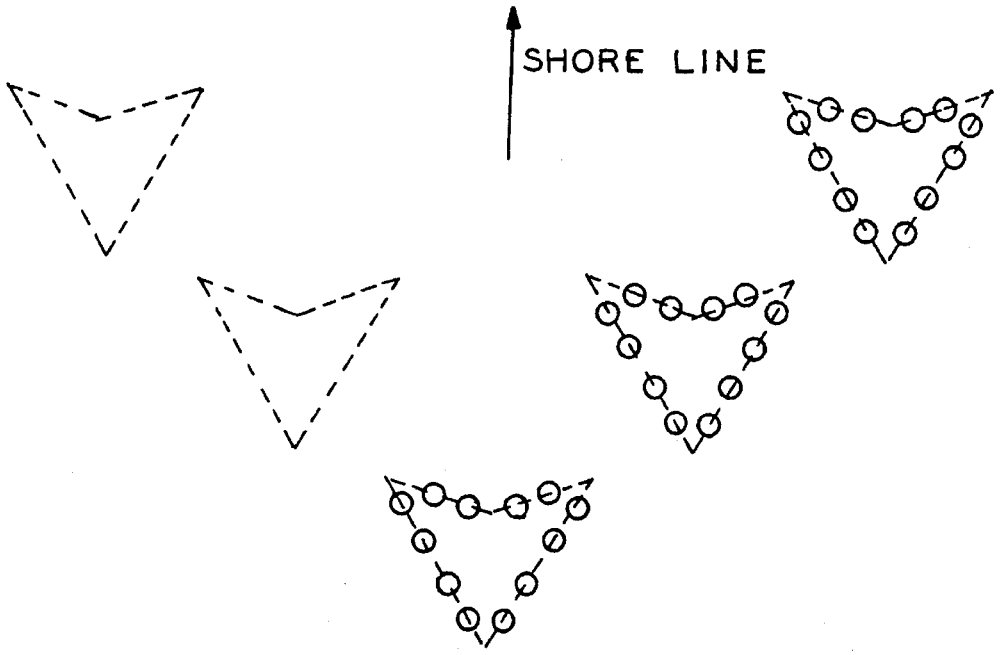
FIG. 6 is a schematic arrangement of several groups of triangular barriers in an extended system along a shoreline.

FIG. 6 shows a plurality of triangular groups of spheres such as in FIG. 5 spaced along an extended length of shoreline. Each group can be about forty eight feet in length with a spacing of forty two feet in length between the apex of one group in one row to the apex of the next group in the next parallel row. There can also be a spacing of about forty feet in distances from the shore between the apex of the group in one row to the apex of another group in another row. The triangular arrangements can also be reversed so that the apex of the two main legs point toward the shoreline instead of away from the shoreline. The triangular arrangement of barriers may have greater wave suppression effect where the shoreline is irregular and waves are directed at varying angles with respect to the shore and barriers instead of the usual ebb and flow of waves directly to and away from the shoreline.

Figure 7A:
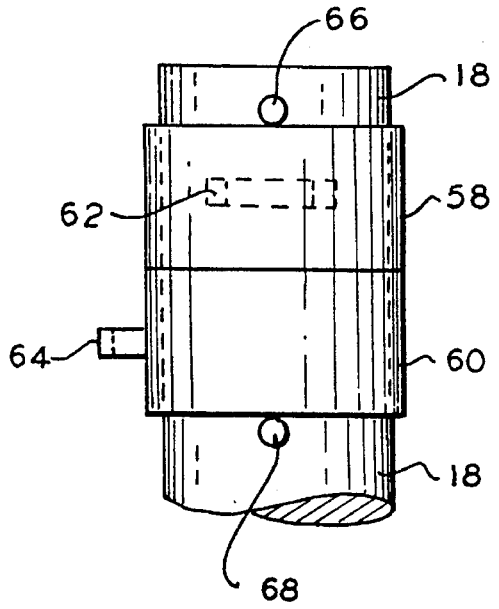
FIGS. 7*a* and 7*b* are top and side views of a segment of piling for connecting to the ends of the netting enclosing the rows of spheres.
Figure 7B:
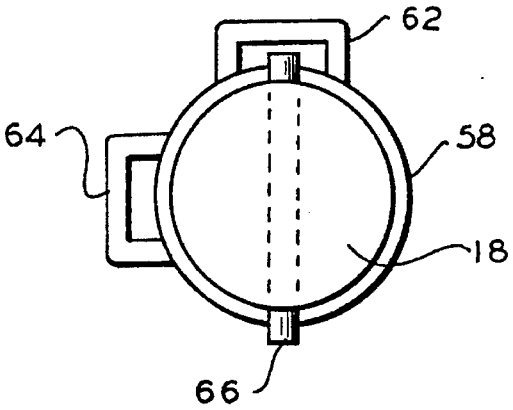

FIGS. 7*a* and 7*b* show side and top views of a piling 18 having rotable collars 58, 60 and tie points 62, 64 to secure the ends of netting of two rows of spheres. The rotatable collars permit movement of the netting ends secured to the pilings to accommodate sudden changes. Retaining pins 66, 68 above and below the two collars, hold the collars in position at the upper end of the piling and limit vertical movement of the netting and spheres. Like rotatable collars and tie points are secured to each piling.

Figure 8:
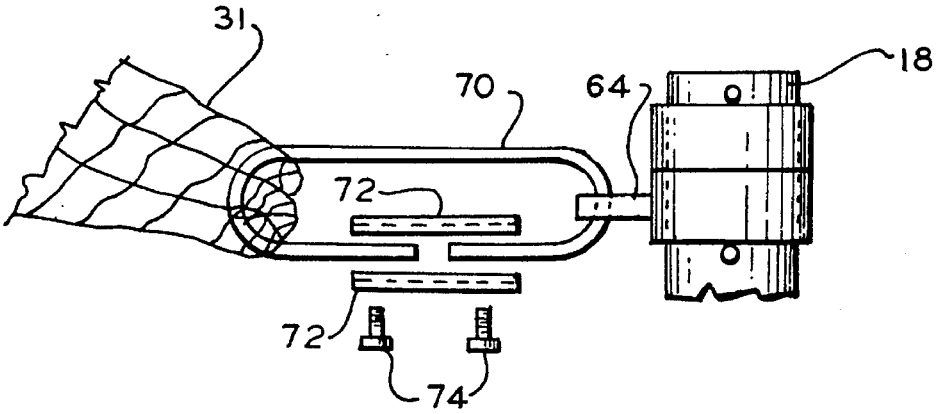
FIG. 8 is a view of a form of clamping configuration to tie the netting to the piling.

FIG. 8 shows a typical clamping structure to tie the ends of the netting to the tie points of the pilings. A strong plastic or rubber strip 70 is passed through the netting end 31 and through tie point 64 of piling 18. Clamp plates 72 are fastened about the ends of strap 70 by locking screws 74 to secure the strap between the netting and piling.

In operation, the system provides a dynamic erosion control device which is movable within limits to absorb and dissipate the effects of wave energy. The heavy netting serves to slow the waves passing through the mesh while the independently rotatable spheres have a foiling effect to oppose and disperse the waves in all directions as the water passes through. The rotatable balls within the spheres likewise diffuse the wave energy as the water exerts pressure on the balls and vice versa. The process is repeated in the various rows along the shoreline. The various elements are flexible and free to move within the limits of the pilings at the ends to counteract currents from varying directions. The system also acts as a barrier to trap sand being washed out by the outgoing tide. This permits a build up of sand around the barrier to extend the shoreline. The system is also portable and can easily be moved further out to attach to new pilings as the new sand increases. It can also be moved and reassembled at other locations as one area improves.

The present invention thus provides a unique shoreline erosion control system having movable and rotatable elements which more efficiently dissipate wave energy to prevent damage to and aid in restoring shore and beach areas. While only a limited number of embodiments have been illustrated and described, other variations may be made in the particular design and configuration without departing from the scope of the invention as set forth in the appended claims.

What is claimed is:

1. A shoreline erosion control system comprising:

a plurality of like rotatable hollow spherical elements extending in a line spaced from and along a shoreline in the path of waves flowing to and from said shoreline, said elements having openings for the passage of water therethrough;

movable means for holding said elements together in said line with a given spacing therebetween, said movable means being a common flexible netting enclosing said elements and having wide area sections around said elements and narrow restricted sections in the spacing therebetween;

means for restricting the dimension of said netting in said narrow sections;

a plurality of air filled balls disposed within each hollow spherical element, said elements being subject to rotation by said waves; and means for limiting the movement of said means for holding said elements including anchoring means secured to the sea bed, the ends of said netting being secured to said anchoring means to limit movement of said netting and elements.

2. The systems of claim 1 wherein said anchoring means are pilings.

3. The system of claim 2 wherein said plurality of hollow spherical elements and common netting are arranged in two parallel spaced groups each enclosed in a separate netting and each netting being secured to the same pilings at the ends thereof, said spherical elements in each group being staggered with respect to the other group so that an element in one group is not directly in line with an element in the other group.

4. The system of claim 3 including a plurality of like parallel spaced groups disposed along an extended shoreline area at a given distance from the shore.

5. The system of claim 2 including means for securing the ends of said netting to said pilings.

6. The system of claim 5 wherein said pilings include rotatable collars secured thereto and tie points for securing said ends of said netting.

7. The system of claim 2 wherein said plurality of spherical elements and common netting are disposed in a plurality of groups each enclosed in a separate netting and forming a triangular arrangement.

8. The system of claim 7 including a plurality of like triangular groups disposed along an extended shoreline area at a given distance from the shore.

9. The system of claim 1 wherein said hollow spherical elements are of metal and include a plurality of arcuate strips secured to a central ring, said strips having openings therebetween for the passage of water therethrough.

* * * * *